US006644089B1

(12) United States Patent
Görgen

(10) Patent No.: US 6,644,089 B1
(45) Date of Patent: Nov. 11, 2003

(54) METHOD FOR ACTUATING A TAPPET IN A LIFTING OR CLAMPING DEVICE, ESPECIALLY FOR FOLDING SHEET METALS IN CAR MANUFACTURE

(75) Inventor: Alois Görgen, Losheim (DE)

(73) Assignee: Thyssenkrupp Technologies AG, Essen (DE)

( * ) Notice: Subject to any disclaimer, the term of this patent is extended or adjusted under 35 U.S.C. 154(b) by 0 days.

(21) Appl. No.: 10/009,920

(22) PCT Filed: May 25, 2000

(86) PCT No.: PCT/EP00/04753

§ 371 (c)(1),
(2), (4) Date: Dec. 6, 2001

(87) PCT Pub. No.: WO01/12355

PCT Pub. Date: Feb. 22, 2001

(30) Foreign Application Priority Data

Aug. 13, 1999 (DE) ..... 199 38 366

(51) Int. Cl.[7] ..... B21D 39/02; B21J 9/18

(52) U.S. Cl. ..... 72/452.9; 72/454; 29/243.58

(58) Field of Search ..... 29/243.58, 243.57, 29/243.5; 72/452.9, 452.8, 306, 312, 454, 322, 323

(56) References Cited

U.S. PATENT DOCUMENTS

| | | | | | |
|---|---|---|---|---|---|
| 2,199,864 | A | * | 5/1940 | Wehr | 72/448 |
| 3,592,037 | A | * | 7/1971 | Van Cleave | 72/319 |
| 3,817,075 | A | * | 6/1974 | Marsh et al. | 72/319 |
| 3,908,437 | A | * | 9/1975 | Bachmann | 72/452.9 |
| 3,939,686 | A | * | 2/1976 | Walters et al. | 72/441 |
| 4,240,279 | A | * | 12/1980 | Rhoades | 72/319 |
| 4,515,355 | A | | 5/1985 | Hunter | |
| 4,535,689 | A | | 8/1985 | Putkowski | 72/452.9 |
| 5,150,508 | A | | 9/1992 | St. Denis | 29/243.5 |
| 5,335,702 | A | * | 8/1994 | Goto | 72/452.9 |
| 5,376,988 | A | | 12/1994 | Osanai | |
| 5,454,261 | A | * | 10/1995 | Campian | 72/454 |

FOREIGN PATENT DOCUMENTS

| | | | | |
|---|---|---|---|---|
| DE | 197 47 291 C1 | | 1/1999 | |
| GB | 780165 | * | 7/1957 | 72/452.9 |
| GB | 2262464 | * | 6/1993 | 72/452.9 |
| WO | WO 97/49128 | | 12/1997 | |

* cited by examiner

*Primary Examiner*—Daniel C. Crane
(74) *Attorney, Agent, or Firm*—McGlew and Tuttle, P.C.

(57) ABSTRACT

Device for actuating a slide or tappet (1) in a lifting or clamping device, especially for folding sheet metals in automobile manufacture. A slide (1) is guided in a base stand (3) and can be driven. The slide (1) supports the folding bed and presses the sheet metals to be folded against stationary folding tools. The slide (1) is supported on at least one wedge surface (7) which can be adjusted in an electromotive manner.

19 Claims, 3 Drawing Sheets

METHOD FOR ACTUATING A TAPPET IN A LIFTING OR CLAMPING DEVICE, ESPECIALLY FOR FOLDING SHEET METALS IN CAR MANUFACTURE

FIELD OF THE INVENTION

The present invention pertains to a device for actuating a slide in a lifting or clamping device, especially for folding sheet metals in automobile manufacture, wherein a slide that is guided in a base and can be driven with a folding bed lying on it presses the sheet metals to be folded against stationary folding tools.

BACKGROUND OF THE INVENTION

In U.S. Pat. No. 5,150,508 discloses a prior-art device of the type described in the introduction. The folding stroke and the needed folding force are brought about by a central hydraulic cylinder located under the slide. In DE 197 47 291 another embodiment of this type has a compressed air cushion located under the slide. The slide moves the folding bed and the workpiece (body sheet metal) located therein against the stationary prefolding and finishing folding tools, which are fastened to displaceable and pivotable means.

SUMMARY AND OBJECTS OF THE INVENTION

The object of the present invention is to do away with hydraulic or pneumatic systems for generating and transmitting the necessary force.

This object is accomplished by the slide with its side facing the workpiece being supported on at least one wedge surface, which can be adjusted by means of an electric motor. In particular, a wedge having a wedge surface can be guided at the base, which wedge can be adjusted by means of an electric motor. The wedge is preferably adjustable essentially at right angles to the working direction of the slide.

In a preferred embodiment of the present invention, a spindle nut is arranged at the wedge for a spindle that is guided therein and can be driven by means of an electric motor. The wedge is adjusted during the rotation of the spindle and the slide is thus raised or lowered. In a space-saving arrangement, the spindle nut is accommodated in a recess of the wedge. The recess is preferably a stepped hole, whose section with the greater diameter accommodates the spindle nut and in whose section with the small diameter the end of the spindle can move. The spindle nut preferably has a recirculating ball thread.

The spindle can be connected to an electric motor via a coupling. The electric motor is preferably controlled by a frequency converter. A transmission may be advantageously intercalated between the electric motor and the coupling. The spindle may be guided in an self-aligning roller thrust bearing on the motor side.

Furthermore, it has proved to be favorable for two wedges with wedge surfaces to be arranged in opposite directions being able to be adjusted simultaneously in opposite directions via a threaded drive with left-hand and right-hand threads and to act on a wedge connected to the slide with associated wedge surfaces. During the rotation of the spindle, which is driven by an electric motor, the two wedges are pushed together or moved apart by the left-hand and right-hand threads of the spindle via the spindle nuts. The consequence of this is that the wedge connected to the slide is moved correspondingly to and fro.

The device, which is preferably called an electromechanical lifting unit, can be used, among other things, in the fields of clamping technique, folding and hemming technique and also in special areas of materials handling technology.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
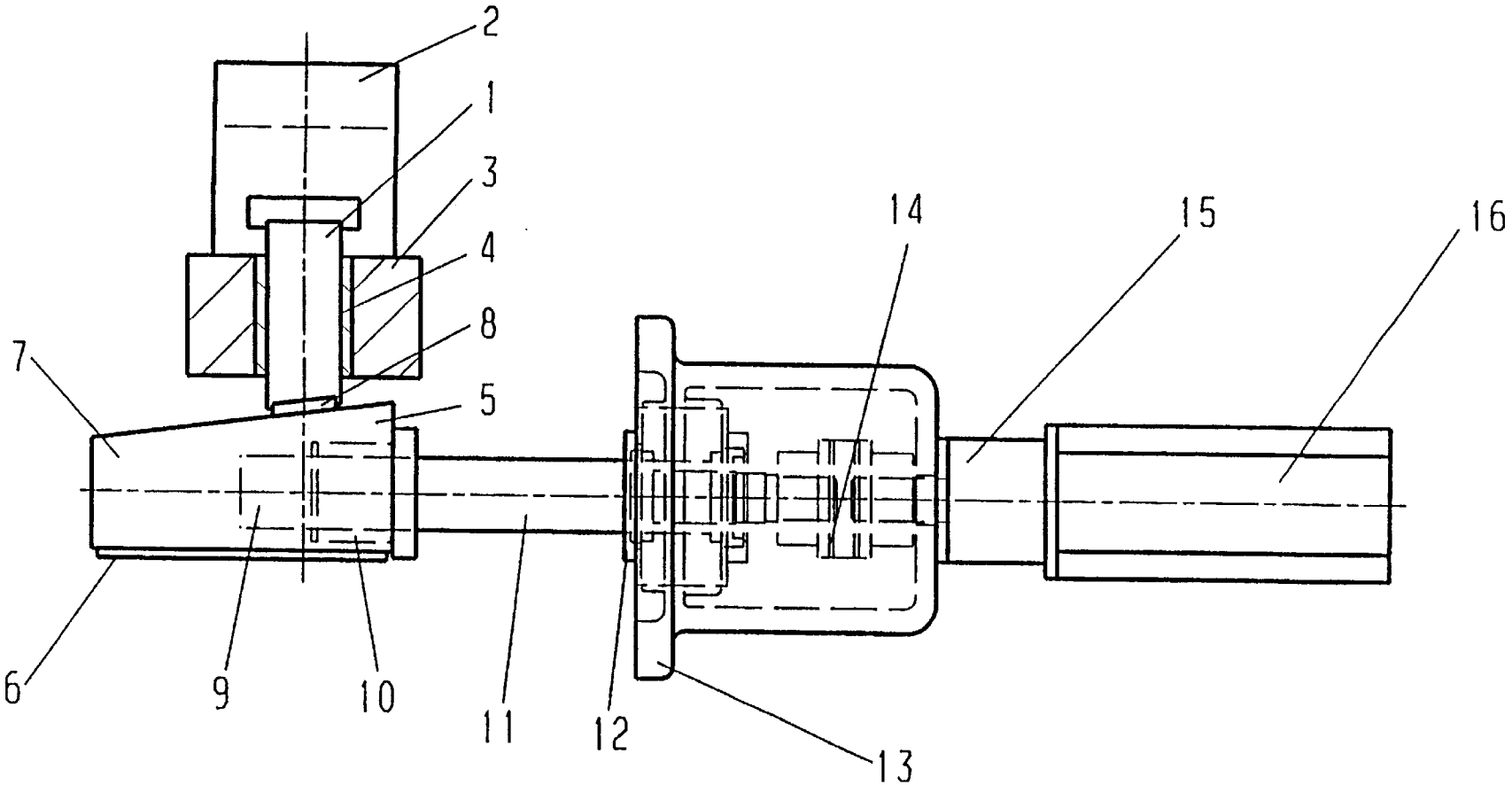
FIG. 1 is a schematic partially sectional view showing a device for folding body sheet metals in automobile manufacture using a wedge.

Referring to the drawings in particular, FIG. 1 shows a slide 1, which can be moved vertically up and down and carries on the top side a folding bed 2 for the body sheet metals to be folded. Stationary folding tools, not shown, are located above the folding bed 2. The slide 1 is guided in a base 3 between sliding plates 4. A horizontally adjustable wedge 5, which is guided on sliding plates 6 arranged at the base 3, is located below the slide 1. The slide 1 is supported with a sliding shoe 8 on an oblique wedge surface 7 facing the slide 1.

A recess 9 is designed as a stepped hole in the embodiment being shown. The recess 9 extends from a front side of the wedge 5, and a spindle nut 10 is inserted axially nondisplaceably and nonrotatably in the section of the stepped hole with the larger diameter. The spindle nut 10 is designed as a recirculating ball thread in the embodiment being shown. A spindle 11, whose free end can move into the section with the smaller diameter of the recess 9, is guided in the spindle nut 10.

The other end of the spindle 11 is guided in a self-aligning roller thrust bearing 12, which is arranged in a bearing housing 13 connected to the base 3. A coupling 14 has an outlet or output side connected to the spindle 11 and has an inlet or driven side connected to the driven shaft of a transmission 15. The coupling 14 can in turn be driven with a frequency converter-controlled electric motor 16. The coupling 14 is located in the bearing housing 13.

In case of a corresponding direction of rotation of the electric motor 16, the spindle 11 is put into rotation after engaging the coupling 14. Due to the transmission in the spindle nut 10, the wedge 5 moves in the horizontal direction and displaces the slide 1 in the vertical direction in the process.

Figure 2:
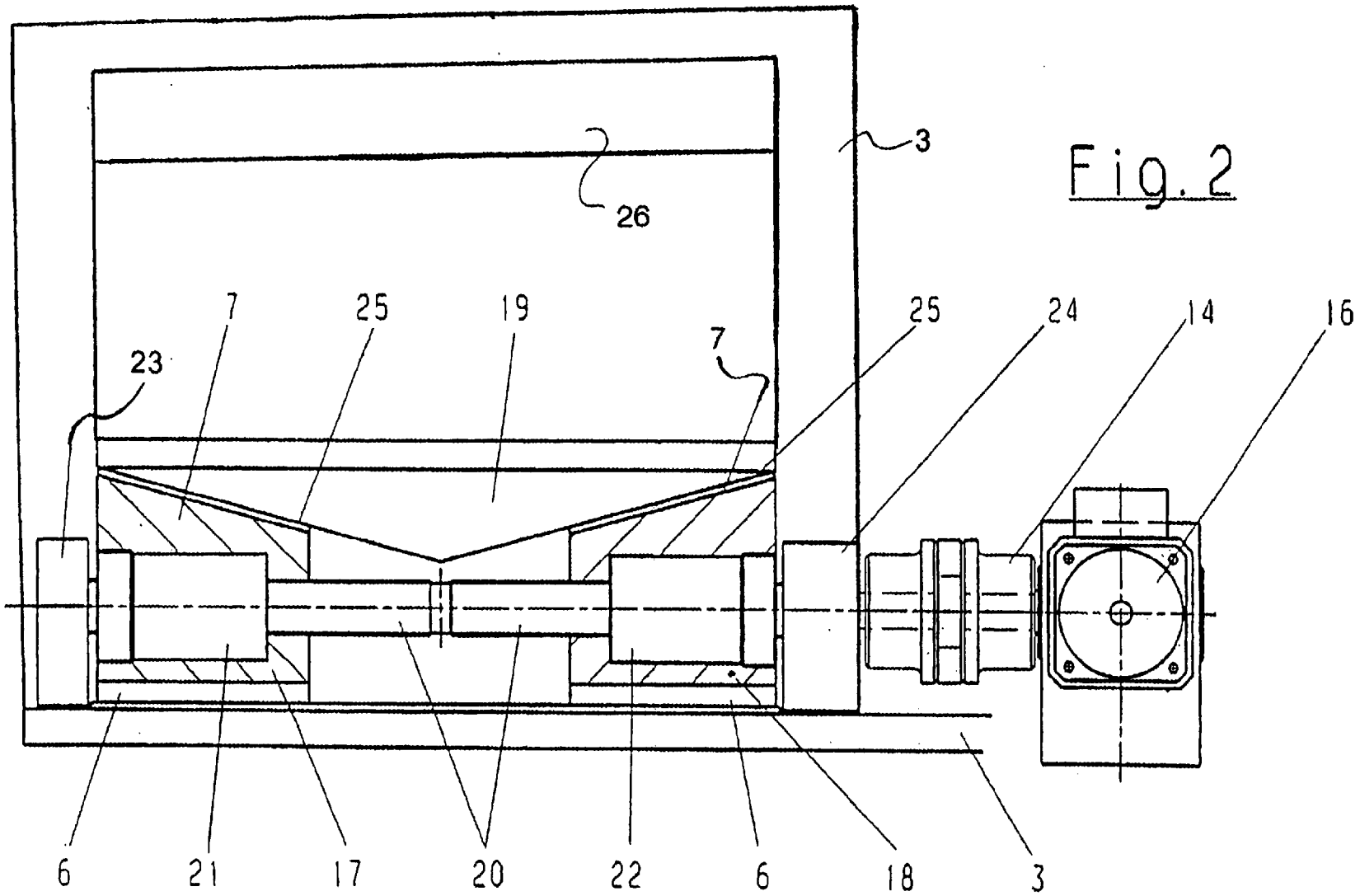
FIG. 2 is a schematic partially sectional view showing another embodiment using two wedges displaceable in opposite directions in the lower position of the wedge.
Figure 3:
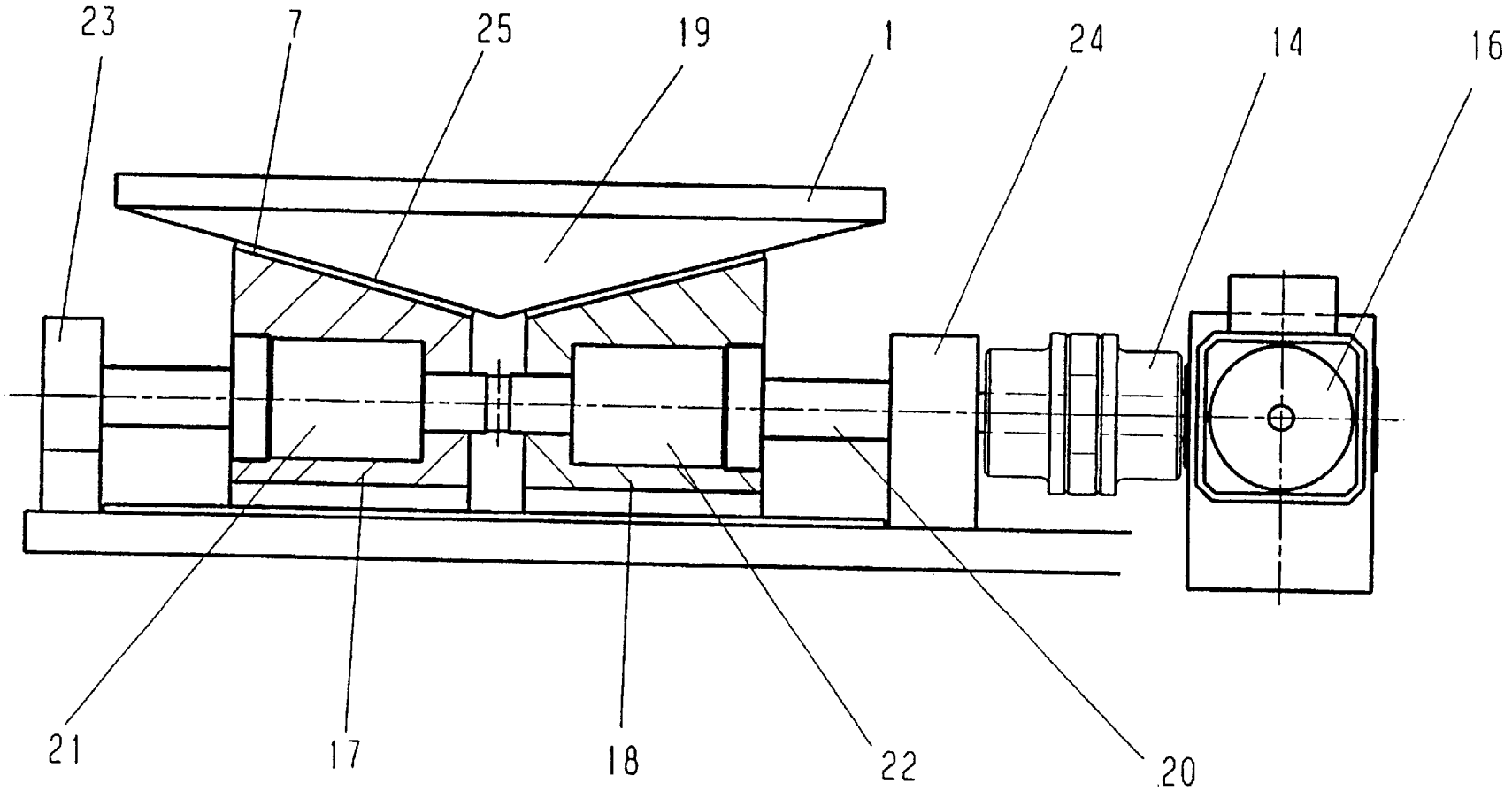
FIG. 3 is a schematic partially sectional view showing the embodiment according to FIG. 2 in the upper position of the wedge.

In FIGS. 2 and 3 a left lower wedge 17 and a right lower wedge 18 are shown. The left lower wedge 17 and the right lower wedge 18 have respective wedge surfaces 7 sloped in opposite directions. These surfaces 7 can be moved in opposite directions by means of a common threaded drive 20 with left-hand and right-hand threads. The threaded drive 20 is driven by a common electric motor 16 via the coupling 14 and has the bearings 23 and 24 on the end side. To lift the slide 1, the two wedges 17, 18 are moved simultaneously toward one another by means of the threaded drive 20, and the corresponding wedge surfaces 7 of the wedges 17, 18 slide on the wedge surfaces 25 of the upper wedge 19 and thus lift the slide 1. After reversing the direction of rotation of the threaded drive 20, the wedges 17, 18 are moved apart and the slide 1 is thus lowered.

While specific embodiments of the invention have been shown and described in detail to illustrate the application of the principles of the invention, it will be understood that the invention may be embodied otherwise without departing from such principles.

What is claimed is:

1. A lifting device for folding sheet metal in automobile manufacture, the device comprising:

a base;

a slide guided in said base;

a slide wedge connected to said slide and having a wedge surface;

two base wedges with oppositely arranged wedge surfaces, said slide and said slide wedge is supported on said two base wedges;

a threaded drive with an anti-clockwise and clockwise thread connected to said two wedges to simultaneously adjust said two base wedges in opposite directions;

an electric motor driving said threaded drive.

2. A device in accordance with claim 1, further comprising:

a stationary folding tool mounted on said base;

a folding bed mounted on said slide, said motor rotating said threaded drive to move said folding bed toward said stationary folding tool and process a sheet arranged between said folding bed and said stationary folding tool.

3. A device in accordance with claim 1, wherein said two base wedges are guided on said base.

4. A device in accordance with claim 1, wherein said two wedges are adjustable essentially at right angles to a working direction of said slide.

5. A device in accordance with claim 1, wherein: said threaded drive includes a spindle nut arranged in each of said two wedges; and a spindle guided in said spindle nuts and driven by said electric motor.

6. A device in accordance with claim 4, wherein each of the spindle nuts are accommodated in a recess of said two wedges.

7. A device in accordance with claim 4, wherein each of the spindle nuts have a recirculating ball thread.

8. A device in accordance with claim 5, wherein each of the recesses is a stepped hole.

9. A device in accordance with claim 4, further comprising a coupling wherein the spindle is connected to said electric motor via said coupling.

10. A device in accordance with claim 8, further comprising a transmission between the electric motor and the coupling.

11. A device in accordance with claim 1, wherein: said threaded drive includes a spindle and a spindle guide with a self-aligning roller thrust bearing wherein said spindle is guided on a motor side in said self-aligning roller thrust bearing.

12. A device for processing a sheet, the device comprising:

a base;

a stationary folding tool mounted on said base;

a folding bed movably mounted along said base in a first direction, said folding bed and said stationary folding tool being receivable of the sheets to be processed;

a first wedge movably mounted between said folding bed and said base, said first wedge being movable in a second direction angularly spaced from said first direction;

a second wedge movably mounted between said folding bed and said base, said second wedge being movable in said second direction, said first and second wedges having wedge surfaces sloped in opposite directions and interacting with said folding bed to move said folding bed in said first direction when said first and second wedges are moved in said second direction;

a threaded drive connected to said first wedge with a first thread, said threaded drive being connected to said second wedge with a second thread, said first thread being in an opposite direction from said first thread, rotation of said threaded drive moving said first and second wedges toward and away from each other;

a motor connected to said thread drive for rotating said threaded drive to move said first and second wedges which then move said folding bed in said first direction toward said stationary folding tool and process the sheet arranged between said folding bed and said stationary folding tool.

13. A device in accordance with claim 12, wherein said first and second base wedges are guided on said.

14. A device in accordance with claim 12, wherein:

said threaded drive includes a spindle nut arranged in each of said first and second base wedges, and a spindle guided in each said spindle nut and electrically driven by said motor.

15. A device in accordance with claim 14, wherein said each spindle nut is accommodated in a recess of said first and second base wedges.

16. A device in accordance with claim 14, wherein said each spindle nut has a recirculating ball thread.

17. A device in accordance with claim 15, wherein each said recess is a stepped hole.

18. A device in accordance with claim 14, further comprising a coupling and comprising a transmission between said motor and said coupling wherein said spindle is connected to said motor via said coupling and said transmission.

19. A device in accordance with claim 14, further comprising a spindle guide with a self-aligning roller thrust bearing wherein said spindle is guided on a motor side in said self-aligning roller thrust bearing.

* * * * *